US006006497A

United States Patent [19]

Waver et al.

[11] Patent Number: 6,006,497

[45] Date of Patent: Dec. 28, 1999

[54] METHODS AND APPARATUS FOR PREPARING A HOT MELT ADHESIVE

[75] Inventors: Bruce A. Waver, Cary, N.C.; David E. Mechling, Cumberland Furnace; Barclay S. Hickman, Centerville, both of Tenn.

[73] Assignee: Reichhold Chemicals, Inc., Durham, N.C.

[21] Appl. No.: 08/824,470

[22] Filed: Mar. 26, 1997

[51] Int. Cl.[6] ..... B65B 63/08

[52] U.S. Cl. ..... 53/440; 264/264

[58] Field of Search ..... 53/440, 447, 411, 53/122, 127, 131.1, 157; 264/264, 255; 427/133, 202, 203

[56] References Cited

U.S. PATENT DOCUMENTS

| | | | |
|---|---|---|---|
| 1,666,730 | 4/1928 | Breeze, Jr. . | |
| 2,639,808 | 5/1953 | Barry et al. | 206/84 |
| 2,762,504 | 9/1956 | Sparks et al. | 206/84 |
| 2,829,073 | 4/1958 | Williams | 117/161 |
| 2,985,554 | 5/1961 | Dickard | 154/53.5 |
| 3,111,449 | 11/1963 | Gold et al. | 161/151 |
| 3,152,030 | 10/1964 | Sampson | 156/278 |

(List continued on next page.)

FOREIGN PATENT DOCUMENTS

| | | |
|---|---|---|
| 0 017 394 A2 | 3/1980 | European Pat. Off. . |
| 140687 | 5/1985 | European Pat. Off. . |
| 0 469 564 A1 | 7/1991 | European Pat. Off. . |
| 0 521 661 A1 | 6/1992 | European Pat. Off. . |
| 0412867 | 9/1993 | European Pat. Off. . |
| 0649718A1 | 4/1995 | European Pat. Off. . |
| 2489351 | 9/1980 | France . |
| 2601616 | 7/1986 | France . |
| 2603021 | 8/1986 | France . |
| 2541966 | 1/1988 | France . |
| 2161990 | 7/1972 | Germany . |
| 3234065A1 | 4/1983 | Germany . |
| 31 38 222C1 | 5/1983 | Germany . |
| 3327289 | 2/1985 | Germany . |
| 86 28 513 U | 7/1987 | Germany . |
| 87 10 132 | 10/1987 | Germany . |
| 3625358 | 2/1988 | Germany . |
| 48-103635 | 12/1973 | Japan . |
| 2 156 302 | 9/1985 | United Kingdom . |
| WO97/27112 | 7/1997 | WIPO . |

OTHER PUBLICATIONS

Brochure, Chub Packaging Machines by Kartridg Pak, undated.

Brochure, Kartridg Pak Commitment to Product Support, undated.

Abstract (Farny), Residue–Free Packaging of Hot–Melt Pressure–Sensitive Adhesives, Adhasion, 31, No. 5, May 1987, pp. 35–36.

Brochure, Rovemar, Vertical Bagger VPX, undated.

Advertisement, Adhesives & Sealants Industry, APS Adhesive Packaging Specialties, Inc., Dec./Jan. 1996, p. 67.

Brochure, Chub Packaging Machinery, BWI Kartridg Pak, undated.

*Primary Examiner*—Linda Johnson

*Attorney, Agent, or Firm*—Myers Bigel Sibley & Sajovec, P.A.

[57] ABSTRACT

Methods and apparatus for preparing a hot melt adhesive for packaging and for packaging same and a packaged, hot melt adhesive product are provided according to the present invention. Particularly, methods and apparatus are provided for rapidly chilling and dusting a hot melt adhesive mass to provide chilled, dusted hot melt adhesive masses which can be packaged without necessitating additional packaging around or between individual masses. A resulting packaged, hot melt adhesive product includes hot melt adhesive masses packaged without necessitating packaging around or between individual masses to prevent the masses from adhering to adjacent masses or shipping containers. The hot melt adhesive masses can be removed from a shipping container and directly inserted into a hot melt adhesive processing unit for various applications without requiring removal or disposal of additional packaging.

15 Claims, 4 Drawing Sheets

U.S. PATENT DOCUMENTS

| | | | |
|---|---|---|---|
| 3,301,741 | 1/1967 | Henrickson et al. | 161/119 |
| 3,314,536 | 4/1967 | Janota et al. | 206/84 |
| 3,341,004 | 9/1967 | Hoeglund | 206/59 |
| 3,403,045 | 9/1968 | Erickson et al. | 117/68 |
| 3,469,363 | 9/1969 | Berckmoes . | |
| 3,509,991 | 5/1970 | Hurst | 206/59 |
| 3,564,808 | 2/1971 | Kent . | |
| 3,837,778 | 9/1974 | Parker | 425/256 |
| 3,851,438 | 12/1974 | Brisman | 53/23 |
| 3,950,207 | 4/1976 | de Zuloaga Amat | 156/308 |
| 4,004,619 | 1/1977 | Eddlemon et al. | 141/11 |
| 4,054,632 | 10/1977 | Franke | 264/145 |
| 4,106,261 | 8/1978 | Greenawalt . | |
| 4,137,692 | 2/1979 | Levy | 53/440 |
| 4,194,438 | 3/1980 | Schmachtel | 93/20 |
| 4,229,872 | 10/1980 | Rozmus | 29/420 |
| 4,236,855 | 12/1980 | Wagner et al. | 53/157 X |
| 4,275,864 | 6/1981 | Richards | 249/79 |
| 4,306,657 | 12/1981 | Levy | 206/447 |
| 4,334,615 | 6/1982 | Butler et al. | 206/447 |
| 4,335,560 | 6/1982 | Robinson | 53/440 |
| 4,450,878 | 5/1984 | Takada et al. | 141/48 |
| 4,450,962 | 5/1984 | Matthews et al. | 206/447 |
| 4,524,566 | 6/1985 | Hauers et al. | 53/534 |
| 4,681,712 | 7/1987 | Sakakibara et al. | 264/24 |
| 4,748,796 | 6/1988 | Viel | 53/411 |
| 4,750,313 | 6/1988 | Kammirer et al. | 53/451 |
| 4,755,245 | 7/1988 | Viel | 53/411 |
| 4,840,823 | 6/1989 | Chigami et al. | 428/35.5 |
| 4,947,618 | 8/1990 | Schneider et al. . | |
| 5,031,386 | 7/1991 | Schneider | 53/551 |
| 5,109,892 | 5/1992 | Somers | 141/11 |
| 5,112,552 | 5/1992 | Wittmann et al. | 264/255 |
| 5,117,612 | 6/1992 | Keim et al. | 53/451 |
| 5,160,686 | 11/1992 | Thaler et al. | 264/225 |
| 5,170,608 | 12/1992 | Petry et al. | 53/377.2 |
| 5,191,750 | 3/1993 | Kammler | 53/551 |
| 5,203,145 | 4/1993 | Kammler et al. | 53/552 |
| 5,241,804 | 9/1993 | Tsuruta et al. | 53/504 |
| 5,257,491 | 11/1993 | Rouyer et al. | 53/428 |
| 5,307,608 | 5/1994 | Muir et al. | 53/440 |
| 5,333,439 | 8/1994 | Bozich et al. | 53/450 |
| 5,373,682 | 12/1994 | Hatfield et al. | 53/440 |
| 5,392,592 | 2/1995 | Bozich et al. | 53/440 |
| 5,398,486 | 3/1995 | Kauss et al. | 53/551 |
| 5,401,455 | 3/1995 | Hatfield et al. | 264/255 |
| 5,715,654 | 2/1998 | Taylor et al. | 53/440 |

FIG. 2
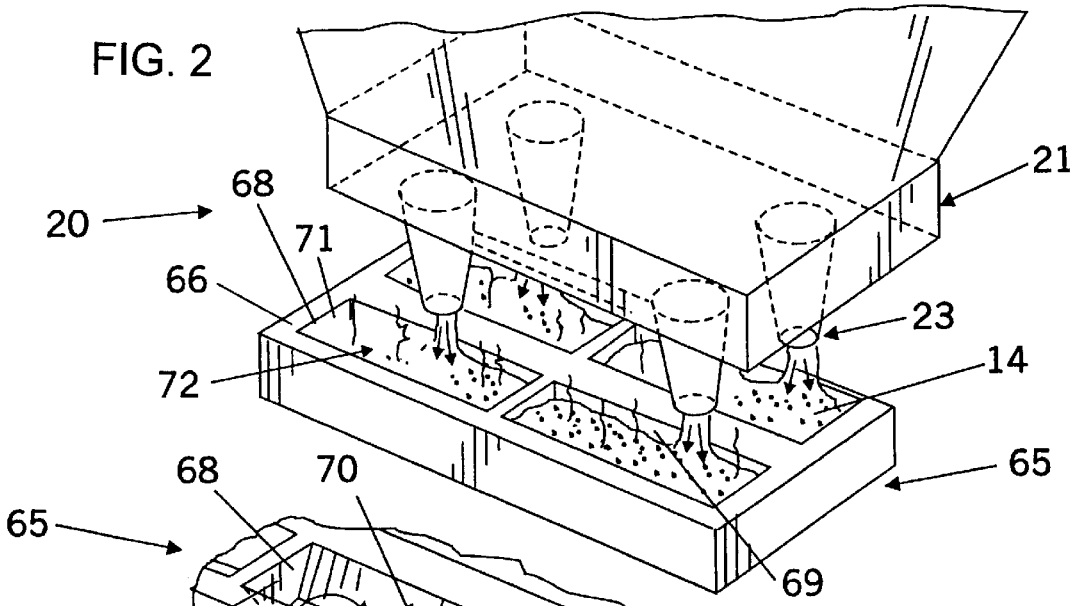
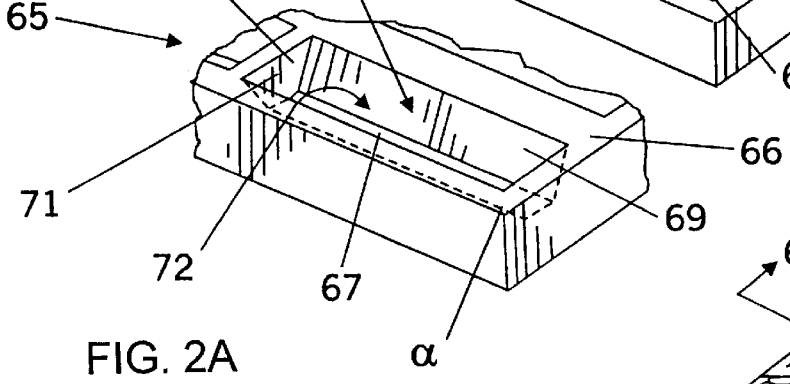
FIG. 2A
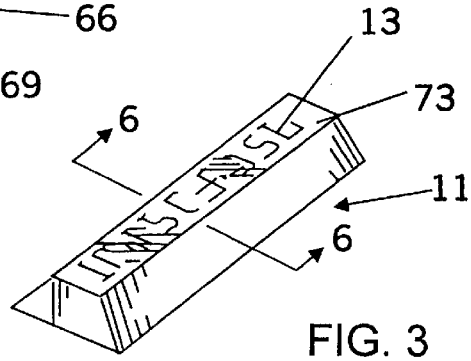
FIG. 3
FIG. 4
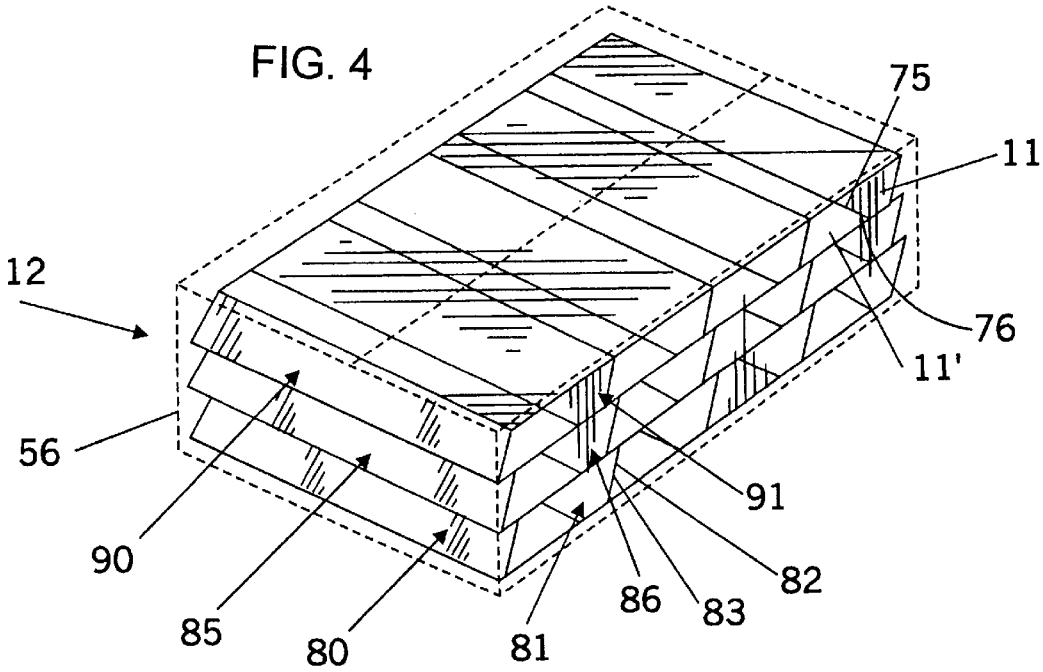

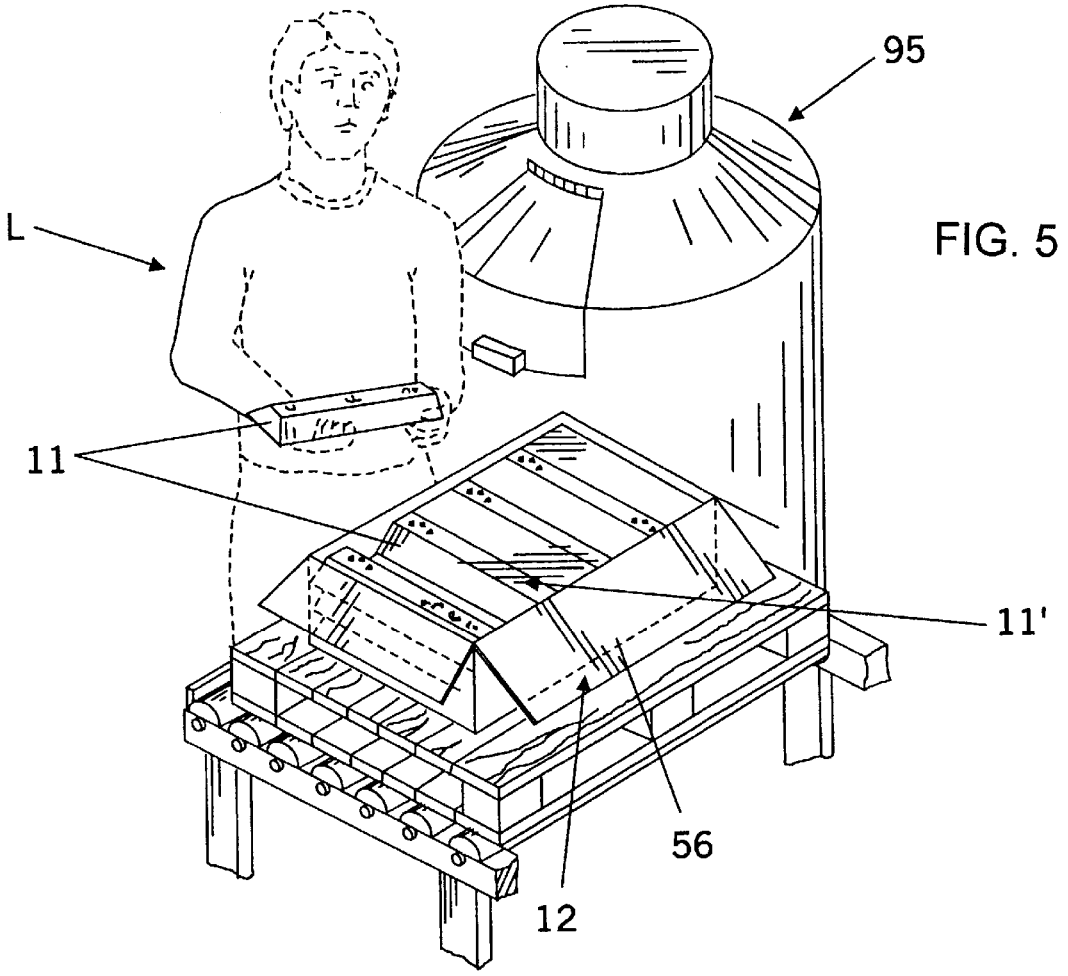
FIG. 5
FIG. 7
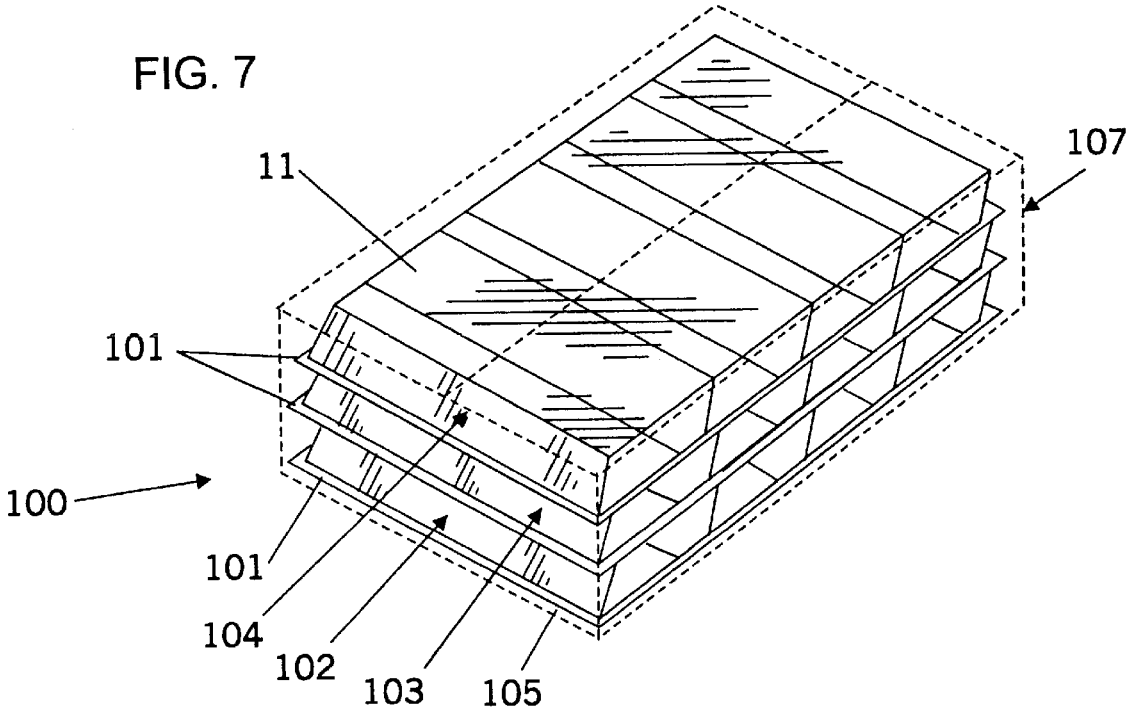

METHODS AND APPARATUS FOR PREPARING A HOT MELT ADHESIVE

FIELD OF THE INVENTION

The present invention relates to methods and apparatus for preparing and packaging hot melt adhesives, and related packaged, hot melt adhesive products.

BACKGROUND OF THE INVENTION

Hot melt adhesives are recognized as adhesives which are tacky when applied in a molten or "hot melt" state. These hot melt adhesives, including pressure sensitive, hot melt adhesives, are typically solids and often tacky at room temperature.

Hot melt adhesives are generally supplied to customers in rigid form for adding to glue pots or other hot melt adhesive processing equipment for melting prior to application. Hot melt adhesives, particularly pressure sensitive adhesives, are also generally supplied to customers at room temperature at which they are extremely tacky. The adhesive properties of pressure sensitive, hot melt adhesives have produced problems in preparation, packaging and processing. For example, pressure sensitive, hot melt adhesives have adhered to other pressure sensitive, hot melt adhesives during packaging, shipping, and storage. Further, hot melt adhesives have adhered to packaging materials such as plastic films, papers or cardboard cartons in various processing conditions.

Attempts have been made to package hot melt adhesives in rigid block portions surrounded by films or other packaging which must be removed prior to supplying the adhesive to a melting pot or other processing equipment. For example, methods and apparatus for packaging hot melt adhesives have been attempted utilizing polymer films filled with molten hot melt adhesive. The high temperature of the molten adhesive has caused melting of certain films including polymer films.

Various of these packaging films have been utilized with certain cooling methods such as water sprays or baths applied to the film during and immediately after filling with the molten, hot melt adhesive. Such packaging processes require elaborate and costly steps and equipment to cool the film during filling. Examples of such water cooled systems are described in U.S. Pat. Nos. 5,373,682 and 5,401,455 to Hatfield. Other plastic films have been utilized to surround individual adhesive masses for packaging to prevent adhesion of the adhesive with other adhesives or packaging.

Attempts have also been made to coat a hot melt adhesive with an anti-adhesive coating prior to wrapping with a plastic film. One such example is proposed in EPO patent 412,867. Also, a micronized powder has been utilized with a silicone coated polymer film to wrap adhesives as proposed in U.S. Pat. No. 5,392,592 to Bozich.

In attempts which have utilized packaging such as polymer films or silicone paper to surround individual adhesive masses, the packaging must be removed from each adhesive mass prior to introducing the adhesive into the melting pot or processing equipment. These film and other wrappers or packages, once removed, create waste and disposal problems. Some polymer films have been used with melting points lower than the melting temperature of the molten pressure sensitive, hot melt adhesive which are designed to be melted in the glue pot with the hot melt adhesive product. These films also create waste in the glue pot and introduce an additive to the adhesive which can adversely affect the adhesive properties of the adhesive.

All of these individually packaged masses which must be removed from individual packaging prior to the introduction into a glue pot, increase time, costs, including labor costs, and waste during application of the adhesive. Such film or individually packaged adhesives may require repetitive tasks of unwrapping by manual labor.

Other attempts have been made to package adhesives utilizing trays or molds formed of a material having non-stick properties or coated with non-tacky material. The adhesive generally has been shipped and transported in these trays for use by the customer where an operation removes the hot melt adhesive product from the tray prior to introduction into the glue pot. The adhesive has been transported in the trays due to the tackiness of the adhesive. Such trays or molds have also been coated with castor oil or powder held in position with static electricity. Generally these trays are costly and produce waste. Such slow cooled adhesives in molds have then generally been individually packaged in film or other exterior individual packaging prior to shipping. One such mold is proposed in U.S. Pat. No. 4,748,796 to Viel.

There is therefore a need to provide methods and apparatus for preparing individual hot melt adhesive masses, particularly of the pressure sensitive type, for packaging which reduces time and costs, including labor costs and steps, and reduces waste resulting from packaging and later processing with the adhesive. Further, there is a need for a hot melt adhesive product which can be utilized without adding waste or deleterious by-products to the adhesive application process.

SUMMARY OF THE INVENTION

It is therefore an object of the present invention to provide methods and apparatus for preparing for a hot melt adhesive for packaging which eliminate the need for individual packaging of hot melt adhesive masses.

It is also an object to provide methods and apparatus which reduce waste in the preparing, actual packaging and processing of hot melt adhesive masses and reduce by-product waste in applications utilizing the hot melt adhesive.

It is a further object to provide methods and apparatus for preparing hot melt adhesive masses for packaging and also packaged, hot melt adhesive products which reduce costly labor, including repetitive steps, involved in the removal of packaging materials prior to use of the hot melt adhesive.

It is a still further object to provide packaged, hot melt adhesive products having a substantially non-stick or non-adhering surface which can be packaged without necessitating individual packaging between or around adjacent hot melt adhesive masses.

In view of the foregoing and other objects, methods and apparatus for preparing hot melt adhesive masses for packaging and packaging the hot melt adhesive masses are hereby provided according to the present invention. Also, packaged, hot melt adhesive products are provided.

Particularly in one aspect of the present invention, methods and apparatus are provided for rapidly chilling, and preferably dusting, a hot melt adhesive mass, particularly of the pressure sensitive type, to prepare chilled, dusted, hot melt adhesive masses which can be packaged without necessitating packaging around or between individual hot melt adhesive masses.

In a second aspect of the present invention, packaged, hot melt adhesive products are provided which include at least one hot melt adhesive mass, and preferably a plurality of hot melt adhesive masses. These hot melt adhesive masses can be packaged in various shipping containers without necessitating packaging around or between individual hot melt adhesive masses to prevent the edges of hot melt adhesive masses from adhering to contacting adjacent edges of adjacent hot melt adhesive masses or to various shipping or packaging containers. The individual hot melt adhesive masses can be removed directly from the shipping container and inserted into a hot melt adhesive processing unit, without requiring removal or disposal of additional packaging around or between each hot melt adhesive mass. Waste and unwanted byproducts are reduced or eliminated from the packaging of the hot melt adhesive masses. Further, no substantial deleterious packaging material is added to the hot melt adhesive application process, thereby reducing waste and adverse byproducts in the application process. The packaged hot melt adhesive products also reduce costly labor and time resulting from repetitive unwrapping of individually packaged, hot melt adhesive products in the application process.

In another aspect of the present invention, a method of preparing a hot melt adhesive mass for packaging includes the following steps. First, a mold is filled with a hot melt adhesive. The mold can also be provided having a non-stick surface and can be dusted with a non-stick dusting agent such as micronized polyethylene or the like. Second, the hot melt adhesive in the mold is subjected to a chilling medium, preferably a cryogen gas to rapidly chill the adhesive. "Chilling" as described herein relates to subjecting an object to a chilling system or medium which actively removes heat from the mass as opposed to a system which passively cools the object by allowing the object to cool over time when exposed to room temperature conditions or slightly cooler than room temperature conditions or the like. The hot melt adhesive is preferably chilled to a temperature between about −5° C. to about −20° C. A prepackage, hot melt adhesive mass is thereby formed having a substantially tack-free outer surface. For the purpose of this disclosure, "prepackage, hot melt adhesive mass" is intended to relate to a hot melt adhesive mass having an outer surface and form which will not substantially adhere to packaging materials or adjacent hot melt adhesive mass and is suitable for packaging without necessitating packaging around or between individual masses.

Each prepackage, hot melt adhesive mass is then removed from the mold, preferably by gravitational exiting. For purposes of this disclosure, "gravitational exiting" is intended to relate to the removal of a hot melt adhesive mass from a mold primarily by subjecting the mass to the force of gravity and without necessitating manual or mechanical extraction of the hot melt adhesive mass from the mold.

Next, the outer surface of the prepackage, hot melt adhesive mass is preferably dusted with a sufficient amount of non-stick dusting agent, such as micronized polyethylene wax or the like, so as to maintain a substantially tack-free surface as the temperature of the hot melt adhesive mass rises when exposed to room-temperature conditions or other conditions encountered in routine shipping and handling. Preferably, the hot melt adhesive mass retains a tack-free surface to temperatures between about 0° C. and 75° C. Still preferably, after the hot melt adhesive masses are removed from the mold, the filling, chilling, removing and dusting steps are repeated to provide a plurality of prepackage, hot melt adhesive masses. The molds utilized in the initial filling step are preferably refilled to form a plurality of hot melt adhesive masses.

Also, in the methods according to the present invention, following the dusting step, the prepackage adhesive masses can be packaged in a container preferably free of additional packing material separating adjacent prepackage, hot melt adhesive masses and separating hot melt adhesive masses and the container. The plurality of hot melt adhesive masses can also be packaged having surfaces of hot melt adhesive masses contacting surfaces of adjacent hot melt adhesive masses and/or the container without the contacting surfaces substantially adhering.

In a fourth aspect of the present invention, an apparatus is provided for packaging a hot melt adhesive mass. The apparatus comprises at least one mold configured to receive a predetermined volume of a hot melt adhesive operatively connected with a conveying device. The conveying device moves the at least one mold between a filling station, a chilling station and an emptying station.

The filling station includes a filling device configured to supply hot melt adhesive to the at least one mold. The chilling station includes a chilling device operatively connected with the conveying device and molds. The chilling device is configured to receive the hot melt adhesive in the at least one mold in a chilling cabinet and to subject the adhesive to a chilling medium to chill the adhesive to a temperature of between about −5° C. to about −20° C. to form a hot melt adhesive mass having a substantially tack-free outer surface and a predetermined size and shape. The chilling is preferably rapid. "Rapid" as used herein relates to a shortened time period of chilling of an object. For example, in one embodiment rapid chilling of a pressure sensitive hot melt adhesive mass occurs in between about 3 minutes and 10 minutes as the result of being chilled as defined herein as opposed to being slowly cooled over an extended time period under passive cooling conditions. The chilled, adhesive mass provided according to the present invention is suitable for processing in a hot melt adhesive processing apparatus.

The mold includes an inner surface defining at least one cavity, preferably having a coefficient of friction insufficient to substantially adhere to a chilled, hot melt adhesive mass therein and sufficient to facilitate gravitational exiting of the adhesive from the mold. The mold can also be dusted with a non-stick dusting agent as described herein.

The apparatus further preferably includes a dusting station having a dusting mechanism or dispenser operatively connected with a vibratory conveying device. The vibratory conveyor is configured to vibrate the dispenser to dispense a dusting agent onto an outer surface of the at least one chilled, hot melt adhesive mass.

In a fifth aspect of the present invention, packaged, hot melt adhesive products are provided. The packaged, hot melt adhesive products include sealable packaging material which has an inner cavity (e.g. a shipping container, film, pouch or the like) and a plurality of hot melt adhesive masses positioned in the inner cavity. Each of the hot melt adhesive masses has a predetermined size and shape defined by an outer surface. The hot melt adhesive masses are preferably formed of a pressure sensitive, hot melt adhesive. A portion of the plurality of hot melt adhesive masses have their outer surfaces contacting at least one other of the outer surfaces of the hot melt adhesive masses. The contacting surface of adjacent surfaces do not substantially adhere at temperatures ranging from about 0° C. to about 75° C. The plurality of hot melt adhesive masses are preferably free of additional packing material separating adjacent hot melt adhesive masses and the shipping container. In one embodiment of the packaged hot melt adhesive product, the plurality of hot melt adhesive masses are positioned in a plurality of vertically stacked layers. Each layer includes a number of the plurality of hot melt adhesive masses which are positioned generally horizontally adjacent one another. The adjacent surfaces of the hot melt adhesive masses of a layer contact without packaging between or separating the adjacent edges and without the contacting edges substantially adhering. A first layer of hot melt adhesive masses is positioned below a second layer of hot melt adhesive masses supporting the second layer. The hot melt adhesive masses of the vertically stacked first and second layers also contact without additional packaging separating the adjacent edges and without the contacting edges substantially adhering. Alternatively, while not necessary, non-stick or releasable separator layers can also be provided between the vertical layers of hot melt adhesive masses to facilitate removal of the masses from the shipping container.

In a still further aspect of the present invention, a method of processing the hot melt adhesive masses is provided. The adhesive masses of a packaged, hot melt adhesive product, preferably of the pressure sensitive type as described herein, are removed from the container at temperatures between about 0° C. and 75° C. and introduced into a hot melt adhesive processing apparatus without removing any packaging from individual masses.

BRIEF DESCRIPTION OF THE DRAWINGS

FIG. 2 is an exploded view of the filler supplying hot melt, pressure sensitive adhesive into a tray of FIG. 1.

FIG. 2A is a partial perspective view of the tray of FIG. 2.

FIG. 3 is a perspective view of a hot melt adhesive mass produced by the methods and apparatus depicted in FIG. 1.

FIG. 4 is a perspective view of an embodiment of a packaged, hot melt adhesive product.

FIG. 5 shows a perspective view of an adhesive mass being removed from the hot melt adhesive packaged product in preparation for processing by an operator.

FIG. 7 is a cutaway view of an alternative embodiment of a packaged, hot melt adhesive product.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to the figures, embodiments of methods and apparatus for preparing hot melt adhesive masses for packaging according to the present invention and the resulting packaged, hot melt adhesive products are shown. For illustrative purposes, the hot melt adhesives are of the pressure-sensitive type. Flex glue and other adhesive products also can be utilized with the apparatus and methods according to the present invention.

Figure 1:
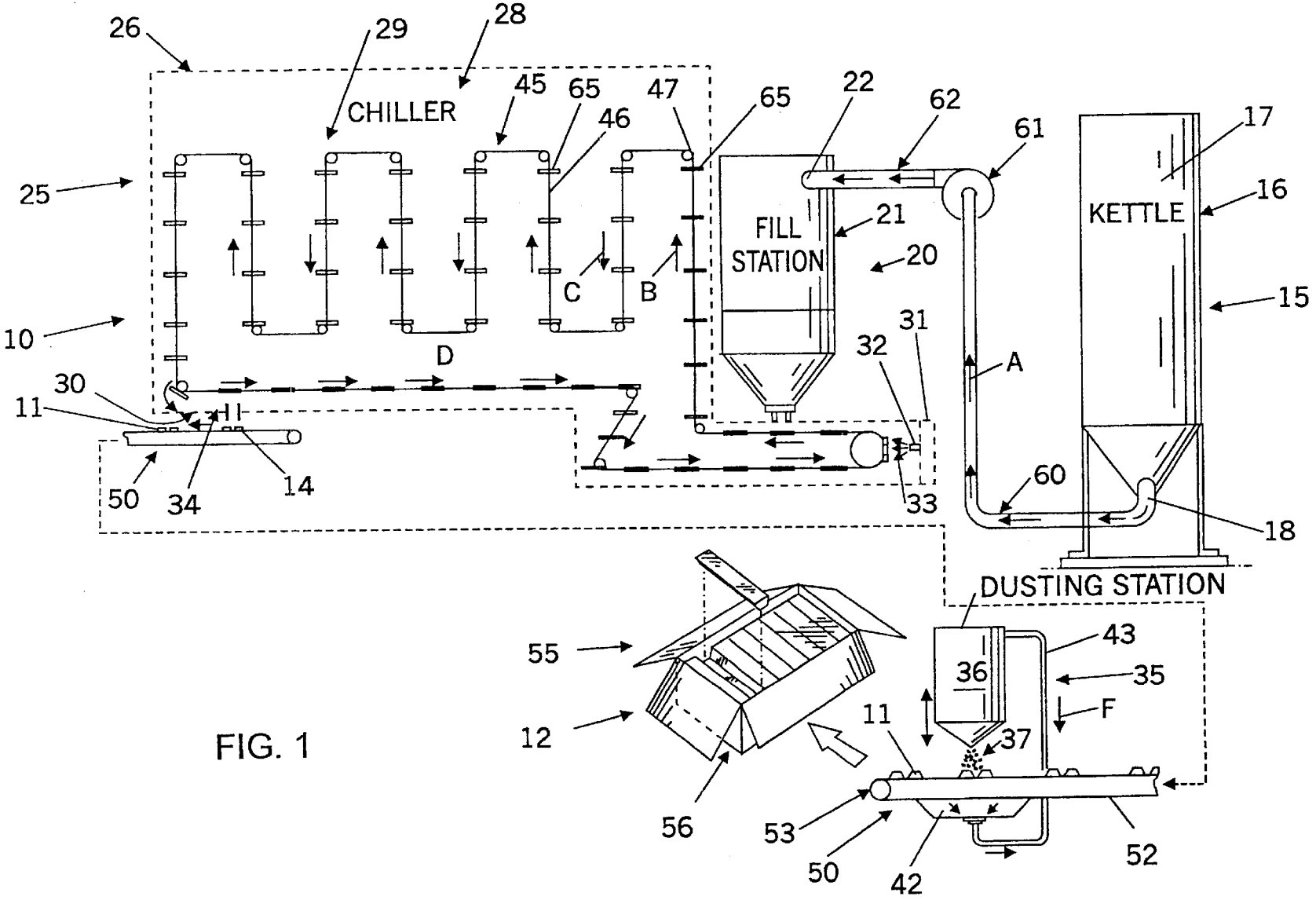
FIG. 1 is a perspective view of an embodiment of the apparatus and methods for preparing for packaging and packaging hot melt adhesive masses.

Referring to FIG. 1, an embodiment of the apparatus 10 according to the present invention is shown. The apparatus includes a heating station 15, a filling station 20, a chilling station 25, an emptying station 30, a dusting station 35 and a packaging station 55 all operatively connected to process adhesive 14, preferably a hot melt adhesive, carried through the various stations by the apparatus 10 as indicated by directional arrows A–F. The heating station 15 includes a kettle 16 or other heating mechanism for heating a quantity of the adhesive 14, preferably to a molten state. The filling station 20 includes a filler 21 or other adhesive dispensing mechanism which is configured to dispense a quantity of hot melt adhesive 14 into a plurality of non-stick trays 65. Each tray 65 can be dusted prior to filling with a non-stick dusting agent by a dusting mechanism (not shown) similar to the dispenser 36 described herein. The trays 65 are connected with a conveyor 45 or other conveying mechanisms for moving the trays 65 through various stations described herein. The chilling station 25 includes a chiller 26 configured to receive the adhesive-filled trays 65 and to rapidly chill the adhesive 14 to provide chilled hot melt adhesive masses 11. The conveyor 45 is configured to empty the chilled hot melt adhesive masses 11 onto a vibratory conveyor 50 in the dusting station 35. The dusting station 35 includes the vibratory conveyor 50 and a dusting dispensing unit 36 attached above the vibratory conveyor 50. The dispenser 36 is configured to dust or coat the hot melt adhesive masses 11 with a non-stick agent such as a micronized wax 37. The vibratory conveyor 50 is configured to move the chilled, dusted hot melt adhesive masses 11 to the packaging station 55 where they are packaged in a shipping container illustrated as a corrugated box 56 without requiring additional packaging to provide a packaged, pressure sensitive, hot melt adhesive product 12.

Still referring to FIG. 1, the apparatus 10 is described in more detail. The kettle 16 has a drum 17, an outlet 18 and a heating mechanism (FIG. 1). The drum 17 is configured to receive a hot melt adhesive in a predetermined quantity. As depicted in FIG. 1, the kettle is preheated, preferably to about 350 degrees Fahrenheit. Individual raw material components are then introduced into the kettle 16. These components are melted and then preferably mixed to produce a homogeneous mixture. A sample of the hot melt adhesive then can be taken from the kettle 16 for quality control testing. When the adhesive 14 within the kettle 16 meets manufacturing specifications, the adhesive 14 can then be pumped to the filling station 20 as described herein. The heating mechanism of the kettle 16 heats a volume of pressure sensitive, hot melt adhesive 14 to a temperature and viscosity, preferably in a molten state at a temperature about 150° C. to 175° C. and about 0–50 poise. The hot melt adhesive 14 is preferably heated to about 163° C. The kettle 16 preferably includes a thermometer or other heat detection mechanism for monitoring the temperature of the adhesive 14. The kettle 16 depicted in FIG. 1 continuously processes a volume of pressure sensitive, hot melt adhesive of about 5000 lbs. The kettle 16 is of a type known to one of ordinary skill in the art is not discussed in further detail herein. Other kettles 16 having a variety of capacities and configurations can be utilized.

The hot melt adhesive 14 illustrated in FIG. 1 is a pressure sensitive, hot melt adhesive composition. The pressure sensitive, hot melt adhesive composition is placed in the kettle 16. Other types of hot melt adhesives can be utilized with the methods and apparatus of the present invention.

Suitable compositions include polymers and copolymers of polyolefins (e.g., polyethylene and polypropylene), polyacrylates, polyvinyl acetates, ethylene esters and copolymers (e.g., ethylene vinyl acetate, ethylene methacrylate, etc.), polystyrenes, polyesters, polyamides, polyvinyl alcohols, polyurethanes, polyepoxides, and aldehyde-containing resins (e.g., phenol-aldehyde resins), and blends and mixtures thereof. These adhesives may also include tackifying resins to improve adhesion and introduce tack into the adhesive. Such resins include, among other materials, natural and modified resins; polyterpene resins; phenolic modified hydrocarbon resins; coumarone-indene resins; aliphatic and aromatic petroleum hydrocarbon resins; phthalate esters; and hydrogenated hydrocarbons, hydrogenated rosins and hydrogenated rosin esters.

The methods and apparatus 10 of the present invention can be utilized to process various volumes of hot melt adhesive 14, preferably ranging from about 1,000 to about 12,000 lbs, but also including smaller or larger quantities of hot melt adhesive. Additionally, various numbers of hot melt adhesive masses 11 can be formed and processed, including a single hot melt adhesive mass 11 and a plurality of hot melt adhesive masses 11. Also, the methods and apparatus 10 for preparing hot melt adhesives, including for packaging, according to the present invention can be utilized with varying volumes, weights, sizes and configurations of adhesives or other compositions. Still referring to FIG. 1, the hot melt adhesive 14 flows from the outlet 18 of the kettle 16 through a first pipe 60 connected between the outlet 18 and a pump 61. The hot melt adhesive 14 flows through the first pipe 60 into the pump 61. The pump 61 illustrated in FIG. 1 is manufactured by Viking Pump, Cedar Rapids, Iowa as Model No. K225 and has a flow rate of about 10 gallons per minute (gal/min.). The pump 61 or other flow control mechanism maintains a desired flow of hot melt adhesive 14 from the kettle 16 to the filling station 20 by pumping the adhesive 14 through a second pipe 62 connected between the pump 61 and the filler 21. The flow rate of the pump 61 can be adjusted to alter or maintain the flow rate of the adhesive from the kettle 16 into the filler 21. Other pumps or flow control devices having different flow rates and which are known to one of skill in the art can also be provided.

In the filling station 20, the filler 21 receives the adhesive 14 in an inlet 22. The filler 21 shown illustrated in FIG. 1 is manufactured by Dick Hilton and Associates of Nashville, Tenn. The filler 21 has a capacity of 0.5 gallons and filling capacity of 2,000 pounds (lbs.) per hour. Preferably, the filler 21 receives adhesive as needed from the kettle 16.

Referring to FIGS. 1, 2, and 2A, in the filling station 20, the filler 21 provides a quantity of melted hot melt adhesive 14 to the plurality of trays 65, illustrated as non-stick trays, connected with the conveyor 45 for moving the trays through the various stations. Four nozzles 23, as illustrated, direct the hot melt adhesive 14 at a flow rate of about 40 pounds per minute (lbs./min.) into the trays 65 during filling. Various configurations and combinations of filling nozzles or heads, including various filling rates, can also be utilized as will be readily apparent to one skilled in the art.

The filler 20 also preferably includes a positive cut-off mechanism. The positive cut-off mechanism (not shown) effects a generally clean cut or slice of the adhesive. This positive cut-off mechanism eliminates any spiderweb-like extension of the adhesive which can occur if not cleanly severed due to the properties of the adhesive. The cut-off mechanism has been fabricated out of steel stock by Dick Hilton and Associates of Nashville, Tenn. Alternatively, other methods of cleanly severing the adhesive mass, including a heated wire or other severing mechanisms known to one in the art could be utilized and are not described in further detail herein. Other fillers and methods of filling can be utilized including other mechanical, hand operated, or automatically or robotically controlled filling apparatus or manual filling.

Referring to FIGS. 2 and 2A, the trays 65 are formed of aluminum. Aluminum is selected to provide the properties of the trays 65 which require the material to serve as a heat transfer medium, accept a non-stick coating, provide a rigid shape, maintain the shape at extremes of heat and cold and resist heat and cold temperature. Other suitable materials for forming the tray 65 include various steels, including stainless steels, aluminum and other like materials which can withstand extremes of heat and cold can be formed in a shape which is retained under such conditions. Each tray 65 contains an upper surface 66 and a floor portion 67 preferably generally parallel to the upper surface 66 and set apart a distance below the upper surface 66. Each tray 65 also has interior walls, including end walls 68 and side walls 69, between the floor 67 and upper surface 66 forming a cavity 70. The end walls 68 are disposed generally opposite one another and generally transverse to the floor 67 and upper surface 66. As seen in FIG. 2A, the side walls 69 are each also disposed at an angle a defined between the plane of the floor 67 and the plane of the side wall 69. The side walls 69, end walls 68 and floor 67 form the substantially trapezoidal shaped cavity 70. The angled side walls 69 facilitate the removal of the hot melt adhesive masses 11 after chilling as described herein.

The cavity 70 has an inner surface 71 formed by the inner surfaces of the floor 67, end walls 68 and side walls 69, which includes a non-stick coating such as a ceramic plasma coat from Impreglon® (FIG. 2A). Other non-stick coatings could be utilized including various plasma coats, various chemical coatings or other coatings including coatings sold under the trademarks Teflon®, Silverstone®, Supra®, nylon, PBDF and others. The ceramic plasma coat provides a non-stick inner surface 71 for the tray 65. As stated, the trays 65, alternatively, can be dusted with a non-stick dusting agent such as micronized polyethylene wax or the like prior to filling of the trays 65.

Referring to FIGS. 1, 2 and 2A, the cavities 70 of the trays 65 are filled with melted hot melt adhesive 14 by the nozzles 23 of the filler 21 into the cavities of tray 65. The non-stick coating of the tray 65 prevents the melted hot melt adhesive 14 from adhering to the inner surfaces 71 of the respective cavities 70. The non-stick coating also facilitates the removal of the hot melt adhesive masses 11 from the cavities 70 of the tray 65 as described as occurring herein in the emptying station 30. In alternative embodiments, the dusting agent supplied to the tray 65 also facilitates the prevention of the hot melt adhesive 12 from adhering to the tray 65 and facilities removal of the masses 11 from the tray 65.

Referring now to FIGS. 2 and 3, the trays 65 also preferably include indicia molding mechanisms. For example, the trays 65 include raised indicia forms on the floor 67 (not shown). The indicia forms imprint indicia 13 in the surface 73 of the hot melt adhesive mass 11 produced in the tray 65 (FIG. 3). Such indicia 13 can include various patterns, designs, trademarks, logos or other markings as desired.

Referring now to FIG. 1, the trays 65 are connected with the belt 46 of a conveyor mechanism 45 which moves the trays 65 through the filling station 20, chilling station 25, emptying station 30, and back to the filling station 20. The conveyor mechanism 45 also includes a drive mechanism (not shown) and a plurality of pulleys 47. The belt 46 is moved by the drive mechanism over the pulleys 47 as indicated by the directional arrows B, C, and D of FIG. 1. The trays 65 can be moved through the chiller 26 by other conveyors or other moving mechanisms known to one of ordinary skill in the art, the details of which are not described herein.

With the trays 65 filled with hot melt adhesive 14, the belt 46 carries the filled trays 65 to the chilling station 25. The belt 46 passes through the inner chamber 29 of the chill cabinet 28 of the chiller 26 which is sized and configured to receive the plurality of the trays 65 containing melted hot melt adhesive 14.

As also shown in FIG. 1, the trays 65 are pivotally mounted with respect to the belt 46 of the conveyor mechanism 45. The trays 65 travel through the filling station 20 and chilling station 25 between the time of filling in the filling station 20 and the time of emptying in the emptying station 30 with openings 72 of cavities 70 generally opposite of the direction of the gravitational force as indicated by directional arrow E.

The chilling station 25 also includes a cryogen gas dispensing mechanism 31 having an outlet 32 which is positioned to supply cryogenic gas to the inner chamber 29 of the chill cabinet 28 suitable cryogen gases include $LN_2$ and $CO_2$ and the like. The cryogen gas dispensing mechanism 31 supplies cryogen gas 33 to the inner chamber 29 in a sufficient quantity to rapidly chill the hot melt adhesive masses 11 to a temperature of between about −5° C. to about −20° C. The chilling station 25 can also include other means of chilling the chiller 26. Such chilling means are known to one of ordinary skill in the art and are not described herein.

In the chilling station 25, the heated adhesive 14 enters the inlet of the chiller 26 at a raised temperature, preferably a temperature between about 150° C. and 175° C., and more preferably about 163° C.

As the trays 65 filled with heated adhesive 14 travel through the chiller 26, the temperature of the adhesive 14 is lowered from the inlet temperature, for example about 163° C., to an outlet temperature of about −5° C. to −20° C. The chiller 26, as illustrated according to FIG. 1, chills a quantity of adhesive 14 of about 2,000 lbs. per hour. The chiller 26 can be configured of various dimensions and configured to receive various numbers of trays 65. In the chiller 26 shown in FIG. 1, the trays 65 and conveyor belt 46 are routed vertically and horizontally to maximize the number of trays 65 within the volume of the chiller 26. Various other chilling mechanisms can be provided to chill the adhesive rapidly from the temperature at the inlet of the chiller of about 163° C. to the chilled exit temperature in the range of about −5° C. to −20° C. Such chilling mechanisms, including other chilling mediums, can be dispensed into the inner chamber 29, or directly onto the adhesive.

The temperature of the chill cabinet 28 can be controlled by the temperature and amount of the cryogen gas 33 discharged therein. The residence time and temperature needed for chilling of the adhesive 14 is dependent on the amount of cooling medium or cryogen gas 33 discharged to the chill cabinet 28, the volume of the chill cabinet 28 and the total mass and entry temperature of the adhesive within the chill cabinet 28. Thus, various configurations of chillers having chill cabinets of varying sizes and shapes can be provided to chill a range of volumes of hot melt adhesive masses 11. In the apparatus 10 of FIG. 1, the residence time of each hot melt adhesive mass 11 is about 60 to 600 seconds for each hot melt adhesive mass 11 having a weight of about 1.1 pounds (lbs.).

One of ordinary skill in the art can perform standard heat capacity calculations and other calculations to determine the residence time required and chilling temperature required for a particular amount of adhesive to reduce temperature of the adhesive from a particular first inlet temperature to a desired second outlet temperature. Variables including residence time, chilling temperature, type of chilling medium, inlet and outlet temperatures and type of adhesive can be adjusted to configure the apparatus and utilize the methods for various applications. The details of calculations associated with adjusting these and other variables are known to one of ordinary skill int he art and are not described in detail herein.

Referring still to FIG. 1, the trays 65 travel through the chiller 26 to the outlet 34 of the chiller 26 where they enter the emptying station 30. As the trays 65 travel through the emptying station 30, the opening 72 of each of the cavities 70 of the trays 65 is pivoted from a generally upright position opposite to the force of gravity to a position towards the gravitational force at an angle sufficient for the adhesive masses to gravitationally exit from the trays indicated by directional arrow E (FIG. 1). The hot melt adhesive masses 11 gravitationally exit from the trays 65 onto the vibratory conveyor 50 and enter the dusting station 35. The trays 65 can be moved to a position to facilitate gravitational exiting by other moving mechanisms such as pivoting or robotically controlled arms, chutes or the like. Such pivoting or moving mechanisms are known to one of skill in the art and are not described in detail herein.

Once the trays 65 have been emptied of the hot melt adhesive masses 11, the trays 65 are returned to the filling station 20, and are thereby refilled. Thus, the trays 65 are preferably reused numerous times to continue refilling and producing hot melt adhesive masses 11.

In the dusting station 35, the vibratory conveyor 50 includes a belt 52, a drive mechanism and a vibration mechanism. As shown in FIG. 1, the wax dispenser 36 is operatively connected with the vibratory conveyor 50 and positioned above the conveyor 50.

The wax dispenser 36 includes a sieve screen. A quantity of micronized wax 37 is positioned in the wax dispenser above the sieve screen. The sieve screen illustrated has a mesh of between about 8 mesh and about 200 mesh. The mesh of the sieve screen is selected to facilitate dusting of the hot melt adhesive masses 11 with the micronized polyethylene wax 37 or other dusting agent. The size of the mesh of the sieve screen is selected based on the dusting agent particle size. The particle size of the wax is preferably between 36–44 microns in the embodiment of FIGS. 1–6. The wax 37, depicted in FIGS. 1–6, is manufactured by Lonza Chemical, Williamsport, Pa. Alternatively, various configurations of sieve screens or other metered dispensing mechanisms can be utilized with this dusting agent dispenser according to the present invention.

The vibratory conveyor 50 is configured to vibrate horizontally. The wax dispenser 36 is operatively connected with the vibratory conveyor 50 and likewise vibrates. As the wax dispenser 36 vibrates horizontally, the wax 37 is dispensed through the screen onto the hot melt adhesive masses 11 (FIG. 1).

Figure 6:
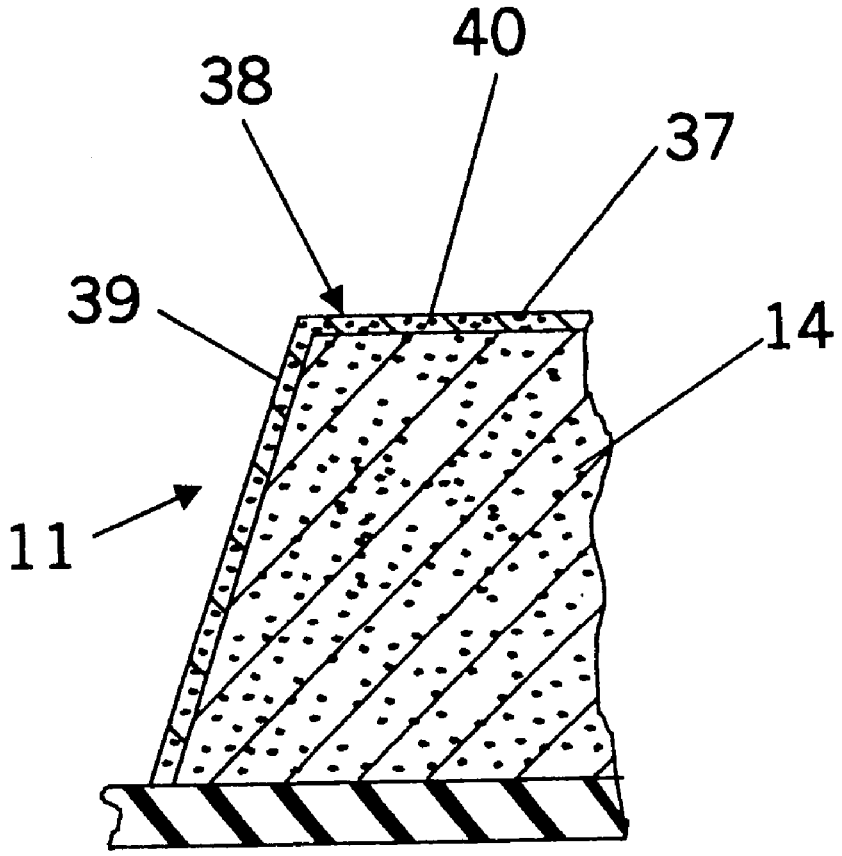
FIG. 6 shows a cross-section view of a hot melt adhesive mass taken along line 6—6 of FIG. 3.

Referring to FIGS. 1 and 6, the wax 37 dispensed onto the hot melt adhesive masses 11 by the wax dispenser 36 provides a dusting or coating 38 to the outer surface 39 of the hot melt adhesive mass 11. The wax coating 38 as illustrated in FIG. 6 is provided to the surface 40 of the chilled, hot melt adhesive 14 such that the dusted, hot melt adhesive masses 11 maintain a substantially tack-free outer surface 39 at temperatures between about 0° C. and 75° C. The hot melt adhesive masses 11 are dusted with the micronized polyethylene wax 37, preferably, such that the wax 37 comprises between about 0.01% and 2.0% of the total weight of the adhesive mass. Various other high melt point polyethylene waxes which are micronized can be used. Alternatively, wax dispensing mechanisms can be utilized including sprays, baths or other methods of providing a wax coating to the adhesive masses. Additionally, other suitable coatings can be supplied to the masses 11 for providing a tack-free surface including like coatings which have a lower melting temperature than the hot melt adhesive and which will not deleteriously affect the adhesive properties of the hot melt adhesive when the adhesive is processed.

As described, the adhesive 14 is filled into the trays 65 in a molten state. As the adhesive is chilled, it is transformed from a molten state at the inlet of the chiller 26 to preferably a solid state upon exiting the chiller 26 at the outlet 34 of the chiller. The rapid chilling reduces the tackiness of the hot melt adhesive mass 11 such that individual masses 11 have a reduced tackiness. As the masses return to temperatures between 0° C. and 75° C., the adhesive masses maintain a substantially tack-free outer surface 39. As illustrated in FIG. 1, the dusted hot melt adhesive masses 11 travel to an end 53 of the vibratory conveyor 50 where they are collected for packaging in the packaging station 55.

Referring again to FIG. 1, the vibratory conveyor 50 also includes slots (not shown) through which the excess wax 37 which is not adhered to the hot melt adhesive masses 11 is collected in a recirculation bin 42 and returned to the wax dispenser mechanism 36 via pipe 43 by a vacuum mechanism or other recirculation means as indicated in the direction of directional arrow F. Various recirculation mechanisms including conveyor belts, buckets or manual recirculation can be utilized to recirculate wax to the wax dispenser mechanism 36, thereby reducing waste. Upon completion of dusting, the dusted, chilled masses 11 are moved to the packaging station 55.

The resulting chilled, dusted hot melt adhesive masses 11 are illustrated in FIG. 3. The hot melt adhesive masses 11 have a generally trapezoidal shape determined by the shape of the tray 65. The masses 11 generally retain the shape at room temperature. Hot melt adhesive masses 11 of various shapes can be formed by molds of varying shapes.

Referring again to FIG. 1, in the packaging station 55, the hot melt adhesive masses 11 are packaged in the corrugated paper box 56 (FIGS. 1 and 4). Other containers can be provided including bags, films including polymer containers of various configurations. The dusted, chilled hot melt adhesive masses are packaged in the container 56 in this embodiment without necessitating additional packaging separating each hot melt adhesive mass 11.

As shown in FIG. 4, a plurality of the pressure sensitive, hot melt adhesive masses 11 are positioned in the inner cavity of the container 56 such that outer surfaces 75 of the masses 11 contact the surfaces 76 of adjacent masses 11' (FIGS. 4 and 5). The wax 57 is supplied to the adhesive 14 in sufficient quantity to prevent adhesion of the masses at temperatures ranging from about 0° C. to about 75° C. The plurality of hot melt adhesive masses can be packed in the box 56 free of additional packaging material separating adjacent adhesive masses 11, 11' with the surfaces of the plurality of adhesive masses 11 contacting surfaces of adjacent masses 11' without substantially adhering.

As also illustrated in FIG. 4, the plurality of the dusted, chilled, hot melt adhesive masses 11 are stacked into three layers 80, 85, 90. The masses 81, 82 of the first layer 80 are positioned generally horizontally adjacent one another. Adjacent vertical edges 83, 84 of the first layer 80 contact without additional packaging between the adjacent edges and without contacting edges 83, 84 substantially adhering. The trapezoidal shape of the chilled, dusted, hot melt adhesive masses 11, 11', 81, 82 facilitates packaging the masses in alternating vertical orientations such that a plurality of trapezoids can form generally congruent horizontal layers 80, 85, 90.

Still referring to FIG. 4, the packaged, pressure sensitive, hot melt adhesive product of this embodiment contains about 24 pressure sensitive, hot melt adhesive masses 11 packaged in the three layers 80, 85, 90 with eight pressure sensitive, hot melt adhesive masses 11 in each of the layers 80, 85, 90. Each pressure sensitive, hot melt adhesive mass 11 weighs between about 1.0 and 1.1 pounds (lbs.). The hot melt adhesive masses 11 can be provided in a variety of weights. Likewise, the packaged, hot melt adhesive product 12 can be provided containing a variety of weights and numbers of hot melt adhesive masses 11. The packaged, hot melt adhesive product 12 contains twenty-four (24) masses 11 weighing a total of about twenty-five (25) pounds (lbs.). In the packaged, hot melt adhesive product 12, each hot melt adhesive mass 11 of the first layer 80, for example hot melt adhesive mass 81, supports a weight of two (2) pounds (lbs.) supplied by the two one (1) pound (lbs.) hot melt adhesive masses 86, 91 positioned above the hot melt adhesive mass 81 in the second layer 85 and the third layer 90. The hot melt adhesive masses 81 of the first layer 80 sufficiently support the weight of the hot melt adhesive masses 86 of the second layer 85 and third layer 90 without additional supports such that the hot melt adhesive masses 81 of the first layer 80 and subsequent hot melt adhesive masses 86, 91 of the second and third layers 85, 90 (respectfully) retain their shape during packaging or shipping. Likewise, the hot melt adhesive masses 86 of the second layer 85 each support about one pound of the single hot melt adhesive mass 91 above in the third layer 90. Also, likewise, the hot melt adhesive masses 86, 91 of the second and third layer 85, 90 do not deform due to weight of other hot melt adhesive masses.

Referring to FIGS. 4 and 5, the packaged, pressure sensitive, hot melt adhesive product 12 is thereby provided which can be packaged and shipped without necessitating additional packaging between individual hot melt adhesive masses 11, 11' such that adjacent outer surfaces 75, 76 of the hot melt adhesive masses 11, 11' contact without substantially adhering at temperatures experienced in normal shipping, storage and use, preferably in the range of between about 0° C. and 75° C. (FIG. 4). Further, the packaged hot melt adhesive product 12 is provided which can be utilized in hot melt adhesive applications without necessitating the unwrapping of packaging from individually wrapped hot melt adhesive masses 11 (FIG. 5).

The packaged, pressure sensitive, hot melt adhesive product 12 is provided containing individual hot melt adhesive masses or bricks which can be directly removed from the box 56 for processing in a glue pot 95 without removing any additional packaging (FIG. 5). Such a packaged, hot melt adhesive product 12 facilitates the ease of use and the repetitive steps and costs associated with opening individually packaged hot melt adhesive masses of prior products.

Still referring to FIG. 5, the hot melt adhesive masses 11 in the form of trapezoidal bricks, can be used in typical processing applications for hot melt adhesives, including but not limited to adhesives for paper and film coating for various labels. Having provided a pressure sensitive, hot melt adhesive packaged product 12 as described herein, the non-adhered pressure sensitive, hot melt adhesive masses or bricks 11 can be removed from the box 56 at temperatures between about 0° C. and 75° C. and introduced into the glue pot 95 or other hot melt adhesive processing apparatus for melting and blending without removing any packaging from individual hot melt adhesive masses 11. Processing equipment for pressure sensitive, hot melt adhesives is well known to one of ordinary skill in the art and is not described herein.

The hot melt adhesive masses 11 do not adhere with adjacent hot melt adhesive masses 11' at temperatures ranging from about 0° C. to 75° C. As the temperature of the hot melt adhesive masses 11 rises from the temperature of the hot melt adhesive mass 11 as it exits the chiller 26 to the room temperature prior to processing the mass 11 in the glue pot 95, the masses 11 do not adhere. The hot melt adhesive masses 11 substantially maintain their shape as the temperature rises. This is important as processing of the masses 11 in end applications often occurs at locations remote from the location of packaging. The packaged hot melt products 12 described according to the present invention are suitable for transport by conventional means such as trucking, air, rail or sea without individual hot melt adhesive masses 11 adhering and without requiring any refrigeration or temperature control.

The methods and apparatus of preparing the hot melt adhesive masses 11 for packaging are illustrated as a continuous process utilizing a continuous system up to processing (FIG. 1). Alternatively, batch processing can be utilized such that only an amount of hot melt adhesive is heated as can be chilled in one step. Further, the various method steps or apparatus pieces can be located at spatially distant positions if desired. Various steps can be performed manually, by automation or mechanisms or by a combination thereof. For example, the hot melt adhesive 14 can be transported manually through various stations, such as the filling station 20, chilling station 25, emptying station 30, dusting station 35 and the like.

Referring to FIG. 7, an alternative embodiment of the packaged, pressure sensitive, hot melt adhesive product 100. This packaged, pressure sensitive, hot melt adhesive product 100 contains dusted, chilled, pressure sensitive, hot melt adhesive masses 11 produced by the methods and apparatus described herein with respect to FIGS. 1–6. This packaged, pressure sensitive, hot melt adhesive product 100 includes a plurality of pressure sensitive, hot melt adhesive masses 11 as described with a separation layer or separator of a non-stick or release coated material, illustrated as silicone paper 101, between each of three layers 102, 103, 104 and a lower surface 105 of box 107. While such silicone paper 101 is not necessary to prevent adhesion of the masses 11, the silicone paper 101 between the layers 101, 102, 103 and the box 107 facilitates removal of the masses 11 for end use in various applications of the hot melt adhesive 14. Other non-stick, or release separator materials or the like, which will not substantially adhere to the masses can be utilized to facilitate removal of the individual hot melt adhesive mass packaging materials can be utilized if desired.

The packaged hot melt adhesive products 12, 100 of the various embodiments are illustrated as having been manually packaged and manually unpacked by an operator L (FIG. 5). Alternatively, packaging mechanisms and apparatus can be provided to package adhesive masses in producing the packaged, hot melt pressure sensitive adhesive products 12, 100 and likewise to remove the hot melt adhesive masses 11 from the boxes 56, 107.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A method of preparing a hot melt adhesive mass for packaging, comprising the steps of:

filling a mold with a hot melt adhesive having a predetermined viscosity and a predetermined first temperature; and subjecting the hot melt adhesive in the mold to a chilling medium to chill the adhesive to a second temperature between about −5° C. to about −20° C. to form a prepackage, hot melt adhesive having a substantially tack-free outer surface;

wherein said subjecting step takes place from about 3 minutes to about 10 minutes.

2. A method of preparing a hot melt adhesive mass for packaging as defined in claim 1, further comprising the steps of:

removing the prepackage, hot melt adhesive mass from the mold;

dusting the outer surface of the prepackage, hot melt adhesive mass with a non-stick dusting agent so as to maintain a substantially tack-free surface as the temperature therefore rises to a third temperature between about 0° C. and 75° C.

3. A method of preparing a hot melt adhesive mass for packaging as defined in claim 2, further comprising, following said removing step, the steps of:

repeating said filling, subjecting, removing and dusting steps to provide a plurality of prepackage, hot melt adhesive masses, said repeated filling step comprising refilling the molds utilized in said filling step to form a plurality of prepackage, hot melt adhesive masses.

4. A method of preparing a hot melt adhesive mass for packaging as defined in claim 3, further comprising following said dusting step, the step of packaging the prepackage, hot melt adhesive masses in a container free of additional packing material separating adjacent prepackage, hot melt adhesive masses.

5. A method of preparing a hot melt adhesive mass for packaging as defined in claim 2, further comprising following said dusting step, the step of packaging that at least one dusted, prepackage, hot melt adhesive mass in a container free of additional packaging material between the outer surface of the prepackage, hot melt adhesive mass and the container.

6. A method of preparing a hot melt adhesive mass for packaging as defined in claim 3, further comprising following said dusting step, the step of packaging the plurality of dusted, prepackage, hot melt adhesive masses in a container free of additional packaging material separating adjacent prepackage, hot melt masses such that surfaces of the plurality of hot melt adhesive masses contact surfaces of adjacent hot melt adhesive masses without said contacting surfaces substantially adhering.

7. A method of preparing a hot melt adhesive mass for packaging as defined in claim 1, wherein said subjecting step further comprises subjecting the hot melt adhesive to a cryogen gas for rapid chilling of the hot melt adhesive.

8. A method of preparing a hot melt adhesive mass for packaging as defined in claim 1, further comprising, prior to said filling step, the step of heating a hot melt adhesive such that said adhesive is in a substantially molten state.

9. A method of preparing a hot melt adhesive for packaging as defined in claim 6, wherein said packaging step further comprises packaging a portion of the plurality of the hot melt adhesive masses in a plurality of stacked layers such that the lower first layer contacts and supports the upper layer without additional support and without the contacting surface of adjacent hot melt adhesive masses adhering.

10. A method of preparing a hot melt adhesive mass for packaging as defined in claim 3, further comprising following said dusting step, the steps of packaging the prepackage, hot melt adhesive masses in a container in a plurality of stacked layers, by packaging a portion of the prepackage, hot melt adhesive masses horizontally adjacent one another in forming each of the stacked layers and free of additional packaging material separating adjacent hot melt adhesive masses such that the surfaces of the plurality of hot melt adhesive masses contact surfaces of adjacent hot melt adhesive masses in each of the stacked layers without substantially adhering and by supplying a non-stick separator material between hot melt adhesive masses of each of the vertically stacked layers.

11. A method of preparing a hot melt adhesive mass for packaging as defined in claim 1, wherein said subjecting step further comprises, subjecting the hot melt adhesive to a chilling medium for a predetermined time of from a first temperature of about 150° to 175° to rapidly chill the hot melt adhesive in the mold to a second predetermined temperature between about −5° C. and −20° C.

12. A method of preparing a hot melt adhesive mass for packaging as defined in claim 2, wherein said dusting step further comprises dusting the cooled, hot melt adhesive masses with a micronized polyethylene wax dusting agent.

13. A method of preparing a hot melt adhesive mass for packaging as defined in claim 2, wherein said dusting step further comprises the step of dusting the outer surface of the prepackage, hot melt adhesive mass with a non-stick dusting agent wherein the dusting agent on the hot melt adhesive mass has a weight of between about 0.01% and 2.0% of the total weight of the adhesive mass.

14. A method of preparing a hot melt adhesive mass for packaging as defined in claim 1, wherein said hot melt adhesive mass is suitable for processing in a hot melt adhesive processing unit.

15. A method of preparing a hot melt adhesive mass for packaging as defined in claim 1, wherein said filling step comprises filling a mold with a pressure sensitive, hot melt adhesive.

* * * * *